US005542744A

United States Patent [19]

Bathrick

[11] Patent Number: 5,542,744

[45] Date of Patent: Aug. 6, 1996

[54] NON-ADJUSTABLE LINEAR DRIVE FOR ARTICULATED FURNITURE

[75] Inventor: Leeland M. Bathrick, Crystal Lake, Ill.

[73] Assignee: C.E.B. Enterprises, Inc., Mundelein, Ill.

[21] Appl. No.: 200,729

[22] Filed: Feb. 23, 1994

[51] Int. Cl.[6] ..... A47C 1/024

[52] U.S. Cl. ..... 297/362.11; 74/89.15; 192/141; 297/330; 297/423.30

[58] Field of Search ..... 297/330, 344.1, 297/362.11, 423.3, 423.32, DIG. 10; 74/89.15; 192/141

[56] References Cited

U.S. PATENT DOCUMENTS

| | | | |
|---|---|---|---|
| 1,796,232 | 3/1931 | Barnes | 192/141 |
| 3,191,196 | 6/1965 | Holm | 297/330 X |
| 4,552,403 | 11/1985 | Yindra | 74/89.15 X |
| 4,712,441 | 12/1987 | Abraham | 74/89.15 |
| 4,893,704 | 1/1990 | Fry et al. | 74/89.15 X |
| 5,044,620 | 9/1991 | Ruch et al. | 74/89.15 X |
| 5,294,179 | 3/1994 | Rudes et al. | 297/DIG. 10 X |

*Primary Examiner*—Peter R. Brown

[57] ABSTRACT

A linear drive for articulated furniture having pre-determined extended and retracted positions. These devices heretofore have been designed to be adjustable, but customer adjustment frequently causes costly damage to the drive and furniture. The drive includes a motor-driven rotary screw and a cooperating nut carrying drive tube which is rotationally fixed to a drive housing to prevent customer adjustment.

6 Claims, 3 Drawing Sheets

NON-ADJUSTABLE LINEAR DRIVE FOR ARTICULATED FURNITURE

BACKGROUND OF THE INVENTION

Articulated furniture and particularly articulated beds and chairs have gained in popularity over the last decade due in part to the demographic enlargement of the North American and European elderly population and also due to an increase in health and comfort awareness.

Usually articulated furniture includes a stationary frame upon which pivotal or pivotal and slidable back and leg frame members are mounted. Linear drives are provided mounted on the frame that engage the movable leg and back frame members to shift them between their retracted and extended positions. Usually the retracted and extended positions in articulated furniture are fixed in that they are not adjustable except by authorized factory personnel.

These linear drives usually include an electric housing enclosing an electric motor that rotates in opposite directions. The housing also includes a reducing gear box driven by the motor and an elongated rotary output screw that drives a nut carried by a reciprocal tube. The motor or one of the gears in the gear box carries a rotary cam that engages limit switches defining the extremes of motion of the reciprocal output drive tube.

The problem arises because distributors and frequently customers become involved in the assembly of these articulated pieces and while the extent of assembly is usually minor, it sometimes involves connecting one of the linear drives. Since the output drive tube is threaded to the output drive screw, if a customer inadvertently manually rotates the tube in one of the other directions, he changes both the retracted position and the extended position of the articulated furniture frame to which it is connected. This frequently causes jamming of the movable frame members into the stationary frame members locking them up and causing permanent damage to the furniture. In all cases customer rotation of the drive tube improperly positions the head frame or foot frame portion from the desired manufacturer pre-set positions.

Faced with these problems, applicant has provided a simple and economical modification to linear drives to prevent the inadvertent adjustment by distributors or customers.

It is a primary object of the present invention to prevent the inadvertent adjustment of linear drives.

SUMMARY OF THE PRESENT INVENTION

In accordance with the present invention, a linear drive for articulated furniture pieces is provided having factory-set extended and retracted positions that cannot easily be altered or changed by a customer.

Toward these ends, the present linear drive includes a housing enclosing a reversely rotatable drive motor, a gear box driven by the drive motor, an output screw driven by the gear box, and an output tube threadedly engaging this screw attachable at one end to the articulated frame member desired to be retracted and extended. According to the present invention, this linearly reciprocal drive tube is rotationally locked to the housing to prevent rotation by the customer.

According to one embodiment of the present invention, a circular stationary guide tube is fixed around the output screw and slidably receives a circular output drive tube that has an internal nut engaging the output drive screw. Rotation between the stationary tube and the slidable drive tube is prevented by an elongated slot in the guide tube and a cooperating projection extending from the drive tube into the slot.

In a second embodiment of the invention, the guide tube is square and slidably receives a square drive tube that prevents relative rotation there-between.

DETAILED DESCRIPTION OF THE PREFERRED EMBODIMENTS

Figure 1:
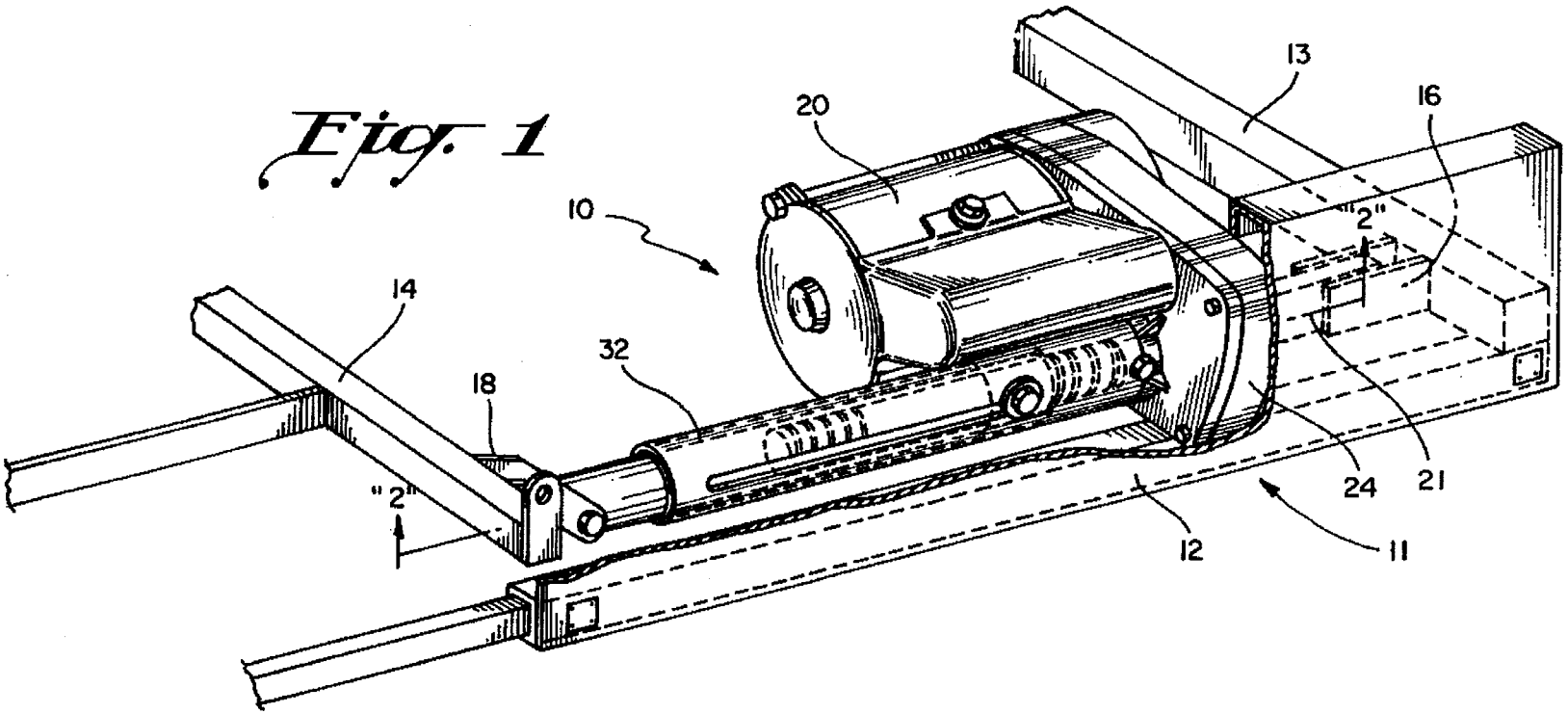
FIG. 1 is a fragmentary perspective of an articulated furniture piece frame having a linear drive according to the present invention mounted therein.

Referring to the drawings and particularly FIGS. 1 to 5, a linear drive 10 according to the present invention is shown mounted in the frame 11 of an articulated piece of furniture such as a bed or chair, and of course it should be understood that the frame 11 is shown in FIG. 1 and the other views only in very fragmented form. Frame 11 includes a stationary side frame member 12 having fixed thereto a stationary cross frame member 13. An articulated frame member 14 is pivotally or slidably mounted by a connection not shown in the drawings to the stationary frame members 12 and 13 and may, for example, carry the movable back frame or movable thigh or movable leg members of the associated furniture piece. Cross frame member 13 has a pair of spaced brackets 16 to which one end of the linear drive 10 is pivotally mounted, and frame member 14 has a similar pair of brackets 18 to which the opposite end of the linear drive 10 is connected.

Figure 3:
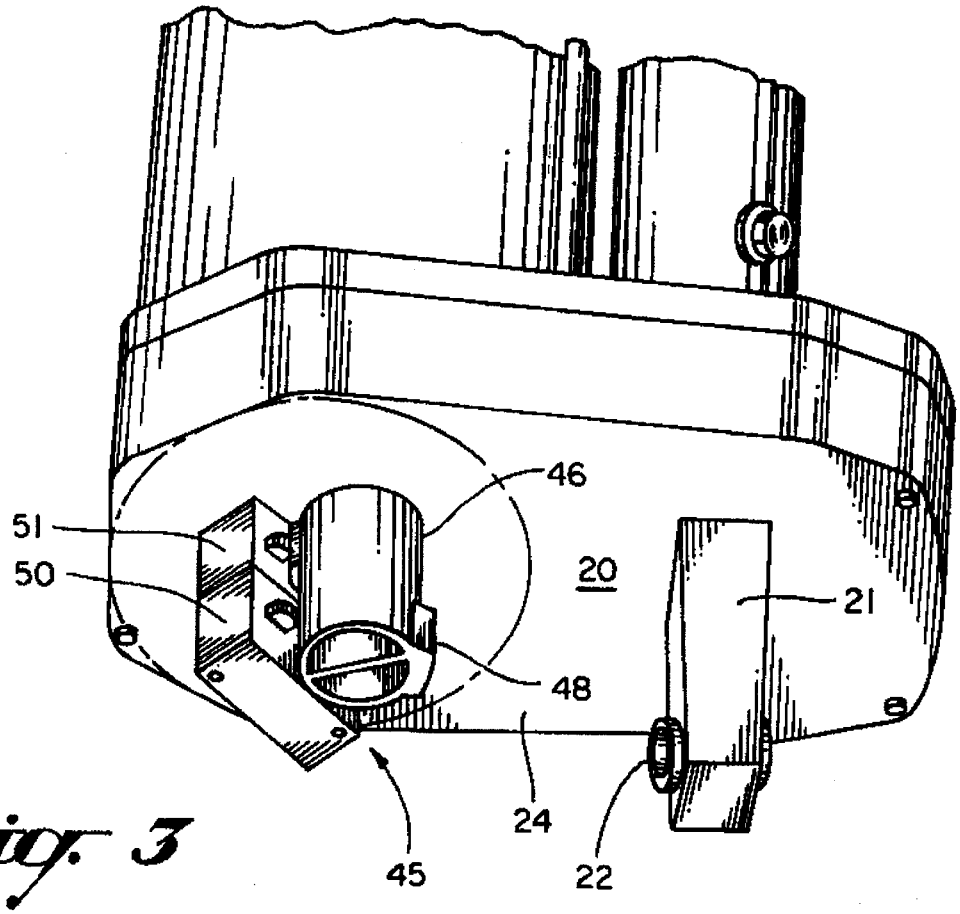
FIG. 3 is a perspective view of the head end of the linear drive shown in FIG. 1.
Figure 4:
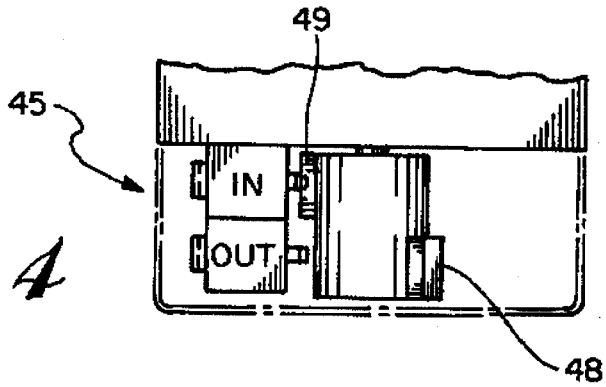
FIG. 4 is a fragmented side view of the position limiting control of the linear drive.
Figure 5:
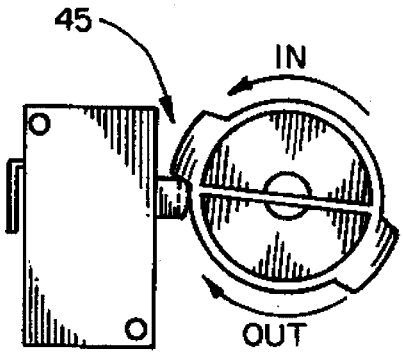
FIG. 5 is an enlarged end view of the position limiting control illustrated in FIG. 4.

Linear drive 10 includes a housing 20 having a pivot post 21 extending from one end thereof shown also in FIG. 3 that has a boss 22 that receives a fastener for pivotally mounting one end of the drive 10 to brackets 16.

The housing 20 encloses a reversely rotatable motor that is operated through a push button "control wand" at the end of a flexible conductor cable(not shown) so that the user can rotate the motor in one direction or the other to extend or retract the articulated members as desired.

Figure 2:
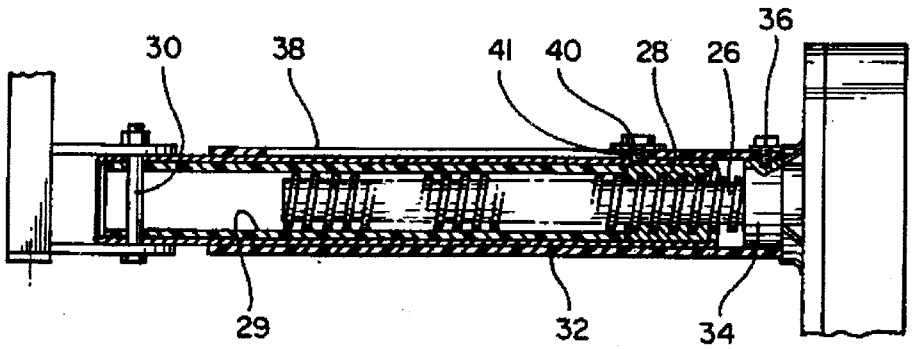
FIG. 2 is a longitudinal fragmentary section through the guide and drive tubes of the linear drive taken generally along line 2—2 of FIG. 1.

Housing 20 has a portion 24 enclosing a reducing gear box having an elongated rotary screw output screw 26 shown clearly in FIG. 2.

Screw 26 threadedly engages a nut 28 carried by a circular drive tube 29 that thereby extends and retracts as the motor rotates in one direction or the other. The distal end of drive tube 29 is pivotally attached by the pin 30 to the brackets 18 connected to the articulated frame member 14.

The drive tube 29 is guided by a cylindrical sleeve 32 in which tube 29 is slidable that is fixed to a circular flange 34 fixed to and carried by the housing 20 by a fastener 36. Rotation between the tube 29 and the sleeve 32 is prevented by an elongated slot 38 in the guide sleeve 32 that receives a threaded member 40 that is threaded into an aperture at 41 in the drive tube 29. Threaded member 40 thereby prevents rotation of tube 29 with respect to guide sleeve 32 and eliminates inadvertent rotation there-between. The threaded member 40 may be welded or otherwise permanently fastened to tube 29 eliminating all possibility of user manipulation.

The linear drive 10 has a limit control device 45 that defines the extended and retracted positions of tube 29 and hence the extended and retracted positions of the frame member 14. Limit device 45 includes a rotary shaft 46 that projects from housing 20 and is driven by either the motor output shaft or by one of the gears in the gear box portion 24. Shaft 46 has a pair of cam lobes 48 and 49 that engage limit switches 50 and 51 respectively that are fixed with respect to the housing 20. The angular position limit switches 50 and 51 are permanently fixed by the manufacturer to the housing unable to be modified by the customer so that if some adjustment is required it is necessary for the linear drive 10 to be returned to the factory for the adjustment.

Figure 6:
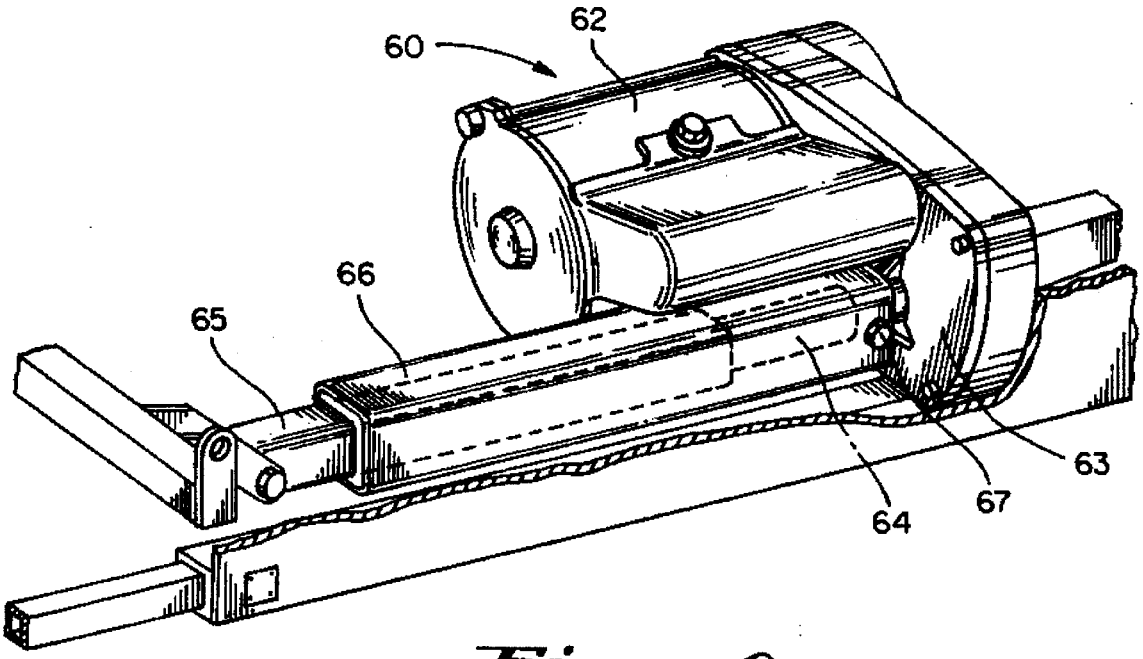
FIG. 6 is a perspective view of a modified form of the linear drive shown in FIG. 1.

Another form of the present invention is illustrated in FIG. 6 and is seen to include a linear drive 60 very similar to the one shown in FIGS. 1 to 5 and includes a motor enclosing housing 62, a gear box area 63 that has an output member drivingly connected to an output screw 34 that engages a nut not shown carried inside a square output drive tube 65. The square output drive tube 65 is slidable in and closely received inside a stationary guide sleeve 66 fixed by a permanent fastener 67 to housing 62. Because output tube 65 and guide tube 66 are square and closely received, relative rotation there-between is prevented.

What is claimed is:

1. A liner drive for an articulated furniture piece such as articulated chairs and beds, comprising: a housing, a rotary motor in the housing having an output shaft, gearing in the housing connected to be driven by the output shaft, a rotary screw projecting from the housing and driven by the gearing, a linearly reciprocable drive member connected to be driven by the rotary screw, first tube means axially fixed with respect to the housing and surrounding a portion of the screw, second tube means telescopically engaging the first tube means and axially fixed to the drive member, means for releasably attaching the second tube means to a load, control means for the motor including means for causing rotation of the motor in opposite directions and means for limiting rotation of the motor in both directions to a predetermined number of revolutions so the linearly reciprocable drive member has a predetermined retracted position and a predetermined extended position, and means for preventing inadvertent reorientation in the retracted and extended positions of the linearly reciprocable drive member from preset positions including means to rotationally lock the first tube means with respect to the second tube means in all positions of the drive member.

2. A linear drive for an articulated furniture piece such as articulated chairs and beds as defined in claim 1, wherein the control means for limiting rotation of the motor in both directions includes rotary cam means and limit switch means, said means for preventing inadvertent reorientation in the retracted and extended positions of the linearly reciprocable drive member including a square drive sleeve fixed to the housing and said linearly reciprocable drive member including a drive nut engaging the drive screw and a square tube fixed thereto, said square guide tube fixed to the housing slidably receiving the square drive tube to prevent relative rotation therebetween.

3. A linear drive for an articulated furniture piece such as articulated chairs and beds, comprising: a housing, a rotary motor in the housing having an output shaft, gearing in the housing connected to be driven by the output shaft, a rotary screw projecting from the housing and driven by the gearing, a linearly reciprocable drive member connected to be driven by the rotary screw, control means for the motor including means for causing rotation of the motor in opposite directions and means for limiting rotation of the motor in both directions to a predetermined number of revolutions so the linearly reciprocable drive member has a predetermined retracted position and a predetermined extended position, and means for preventing inadvertent reorientation in the retracted and extended positions of the linearly reciprocable drive member from present positions including means to rotationally lock the drive member with respect to the housing in all positions of the drive member, said control means for limiting rotation of the motor in both directions including rotary cam means and limit switch means, said rotary cam means being driven by the motor and said limit switch means being positioned to be engaged by the rotary cam means, said linearly reciprocable drive member including a drive nut engaging the rotary screw and a round drive tube fixed thereto, a stationary guide sleeve fixed to the housing that slidably receives the round tube, said means for preventing inadvertent reorientation in the retracted and extended positions of the linearly reciprocable drive member including a slot in one of the round tube and guide sleeve and a projection on the other extending into the slot to prevent rotation between the round tube and the guide sleeve.

4. An articulated chair or bed, comprising: a frame, an articulated member movably mounted on the frame, a linear drive mounted on the frame for moving the articulated member relative to the frame including a housing, a rotary motor in the housing having an output shaft, gearing in the housing connected to be driven by the output shaft, a rotary screw projecting from the housing and driven by the gearing, a linearly reciprocable drive member connected to be driven by the rotary screw, first tube means axially fixed with respect to the housing and surrounding a portion of the screw, second tube means telescopically engaging the first tube means and axially fixed to the drive member, means for releasably attaching the second tube means to a load, control means for the motor including means for causing rotation of the motor in opposite directions and means for limiting rotation of the motor in both directions to a predetermined number of revolutions so the linearly reciprocable drive member has a predetermined retracted position and a predetermined extended position, and means for preventing inadvertent reorientation in the retracted and extended positions of the linearly reciprocable drive member from preset positions including means to rotationally lock the first tube means with respect to the second tube means in all positions of the drive member.

5. An articulated chair or bed as defined in claim 4, wherein said means for preventing inadvertent reorientation in the retracted and extended positions of the linearly reciprocable drive member includes a square drive sleeve fixed to the housing and said linearly reciprocable drive member including a drive nut engaging the drive screw and a square drive tube fixed thereto, said stationary square guide sleeve fixed to the housing slidably receiving the square drive tube to prevent relative rotation therebetween.

6. An articulated chair or bed, comprising: a frame, an articulated member movably mounted on the frame, a linear drive mounted on the frame for moving the articulated member relative to the frame including a housing, a rotary motor in the housing having an output shaft, gearing in the housing connected to be driven by the output shaft, a rotary screw projecting from the housing and driven by the gearing, a linearly reciprocable drive member connected to be driven by the rotary screw, control means for the motor including means for causing rotation of the motor in opposite directions and means for limiting rotation of the motor in both directions to a predetermined number of revolutions so the linearly reciprocable drive member has a predetermined retracted position and a predetermined extended position, and means for preventing inadvertent reorientation in the retracted and extended positions of the linearly reciprocable drive member from present positions including means to rotationally lock the drive member with respect to the housing in all positions of the drive member, including control means for limiting rotation of the motor in both directions including rotary cam means and limit switch means, said rotary cam means being driven by the motor and said limit switch means being positioned to be engaged by the rotary cam means, said linearly reciprocable drive member including a drive nut engaging the drive screw and a round drive tube fixed thereto, a stationary guide sleeve fixed to the housing that slidably receives the round tube, said means for preventing inadvertent reorientation in the retracted and extended positions of the linearly reciprocable drive member including a slot in one of the round tube and guide sleeve and a projection on the other extending into the slot to prevent rotation between the round tube and the guide sleeve.

* * * * *